US005951359A

United States Patent [19]

Prakopcyk et al.

[11] Patent Number: 5,951,359

[45] Date of Patent: Sep. 14, 1999

[54] INDICIA-BEARING BALLOON AND METHOD OF MANUFACTURE

[75] Inventors: Jill Robinson Prakopcyk, Asbury; Debra A. Reichert, Pittstown, both of N.J.

[73] Assignee: Celebration Station, N.J.

[21] Appl. No.: 08/844,319

[22] Filed: Apr. 18, 1997

[51] Int. Cl.[6] ..... A63H 3/06

[52] U.S. Cl. ..... 446/220; 446/223; 446/226

[58] Field of Search ..... 446/220, 222, 446/223, 226, 268, 321, 391; 40/538; 244/153 R; 428/195, 16

[56] References Cited

U.S. PATENT DOCUMENTS

| | | | |
|---|---|---|---|
| 1,567,132 | 12/1925 | Gill | 446/226 |
| 2,309,447 | 1/1943 | Greneker | 428/16 |
| 3,026,648 | 3/1962 | Lemelson | 446/226 |
| 4,648,188 | 3/1987 | Blair | 40/538 |
| 4,722,498 | 2/1988 | Cameron | 244/153 R |
| 5,312,673 | 5/1994 | Dressler | 428/195 |
| 5,314,370 | 5/1994 | Flint | 446/391 |

*Primary Examiner*—Robert A. Hafer
*Assistant Examiner*—Bena B. Miller
*Attorney, Agent, or Firm*—Anthony J. Casella; Gerald E. Hespos; Ludomir A. Budzyn

[57] ABSTRACT

A method is provided for applying personalized indicia, such as a photograph, to a balloon. The method includes employing a commercially available copier to reproduce an image from a photograph onto a thin plastic film having a pressure sensitive adhesive backing. The plastic film is then adhered to a deflated balloon, and the balloon is subsequently inflated. The image applied to the plastic film conforms to the non-planar shape of the balloon without becoming separated therefrom.

12 Claims, 2 Drawing Sheets

INDICIA-BEARING BALLOON AND METHOD OF MANUFACTURE

BACKGROUND OF THE INVENTION

1. Field of the Invention

The subject invention relates to balloons that can carry a unique personalized message or picture and to a method of making such balloons.

2. Description of the Prior Art

Helium filled balloons have been used for many years as festive decorations, and often are given out as presents, souvenirs or party favors. Bouquets of balloons often replace bouquets of flowers on special occasions. Additionally, balloons may be incorporated into center pieces or promotional give-aways.

Balloons typically are formed from either latex or a Mylar foil. Latex balloons will stretch considerably in response to forces exerted by the helium or air directed into the balloon under pressure. Mylar foil balloons are less elastic. However, Mylar foil balloons typically have a longer life and are substantially impervious to gas flow. Thus, a foil balloon typically will retain its shape for a longer time than a latex balloon.

Balloons often are printed with fanciful designs or with special messages. However, neither latex balloons nor foil balloons are well suited to conventional printing processes. Thus, balloons typically are printed with specialty messages only in fairly large numbers (i.e., 500 or more). Balloons are not well suited to the various cottage industries of printing that have developed around the printers and copiers that are available in most offices and many homes.

Posters, greeting cards, center pieces and party favors can be made with photographs. For example, favors or center pieces at a class reunion might include photographic excerpts from a yearbook, with each attendee receiving a party favor that includes their own photograph from the yearbook. The technical limitations and costs associates with printing on balloons have prevented balloons from being employed on such personalized displays, and particularly have prevented the use of photographic indicia on balloons.

In view of the above, it is an object of the subject invention to provide balloons with personalized indicia.

It is another object of the subject invention to provide balloons with photographic indicia.

Still a further object of the subject invention is to provide a method for placing personalized indicia, such as photographs on balloons.

SUMMARY OF THE INVENTION

The subject invention is directed to balloons having unique personalized indicia thereon, such as high quality photographic indicia. The balloons may be formed from latex, Mylar foil or other flexible gas retaining sheet material. The balloons further include a thin flexible layer of film. The film may be a plastic, such as polyester, and includes opposed front and rear surfaces. The rear surface of the film is secured to the latex or foil balloon. The front face of the film has an image applied by a conventional photostatic copier, a color copier, an inkjet printer or a laser printer. Thus, the image conforms to the shape of the balloon when the balloon is inflated.

The subject invention also is directed to a method for placing a personalized message, logo or photograph on a balloon. In one aspect of the invention, the method comprises the steps of obtaining or providing a desired message, logo or photograph defining an image to be placed on the balloon. The photograph may be message, logo or photograph. The method further comprises the step of providing a thin flexible plastic film having a front surface suitable for receiving toners, such as color toners applied by color copiers, inkjet printers or laser printers. The plastic film further includes a rear side having a pressure sensitive adhesive and a peelably removable backing sheet. The plastic film with the backing sheet is loaded into a copier or printer for reproducing the photograph thereon. This step of the process may merely include placing the original message, logo or photograph onto the glass copying surface of the copier and operating the copier to transfer the image onto the front face of the plastic film. Alternatively, this step of the process may comprise scanning the message, logo or photograph to enable digital transfer of the image onto the plastic sheet by passing the plastic sheet through a printer operatively connected to the scanner. Still further, this step of the process may be completed by having the photograph produced by a digital camera and downloading the digitally reproduced image onto the plastic film that has been loaded into the printer.

The method proceeds by providing a deflated balloon. The balloon may be formed from latex, foil or other foil material and is placed on a planar supporting surface. The method proceeds by removing the backing sheet from the plastic film that has the image reproduced onto the front face thereof. The rear adhesively backed face of the plastic film then is pressed firmly against the flat surface of the deflated balloon so that the plastic film is securely adhered to the balloon, and so the image on the front face is readily visible. The balloon then is inflated into a non-planar configuration, and the plastic film with the image thereon conforms to the non-planar shape of the inflated balloon.

DETAILED DESCRIPTION OF THE PREFERRED EMBODIMENTS

Figure 1:
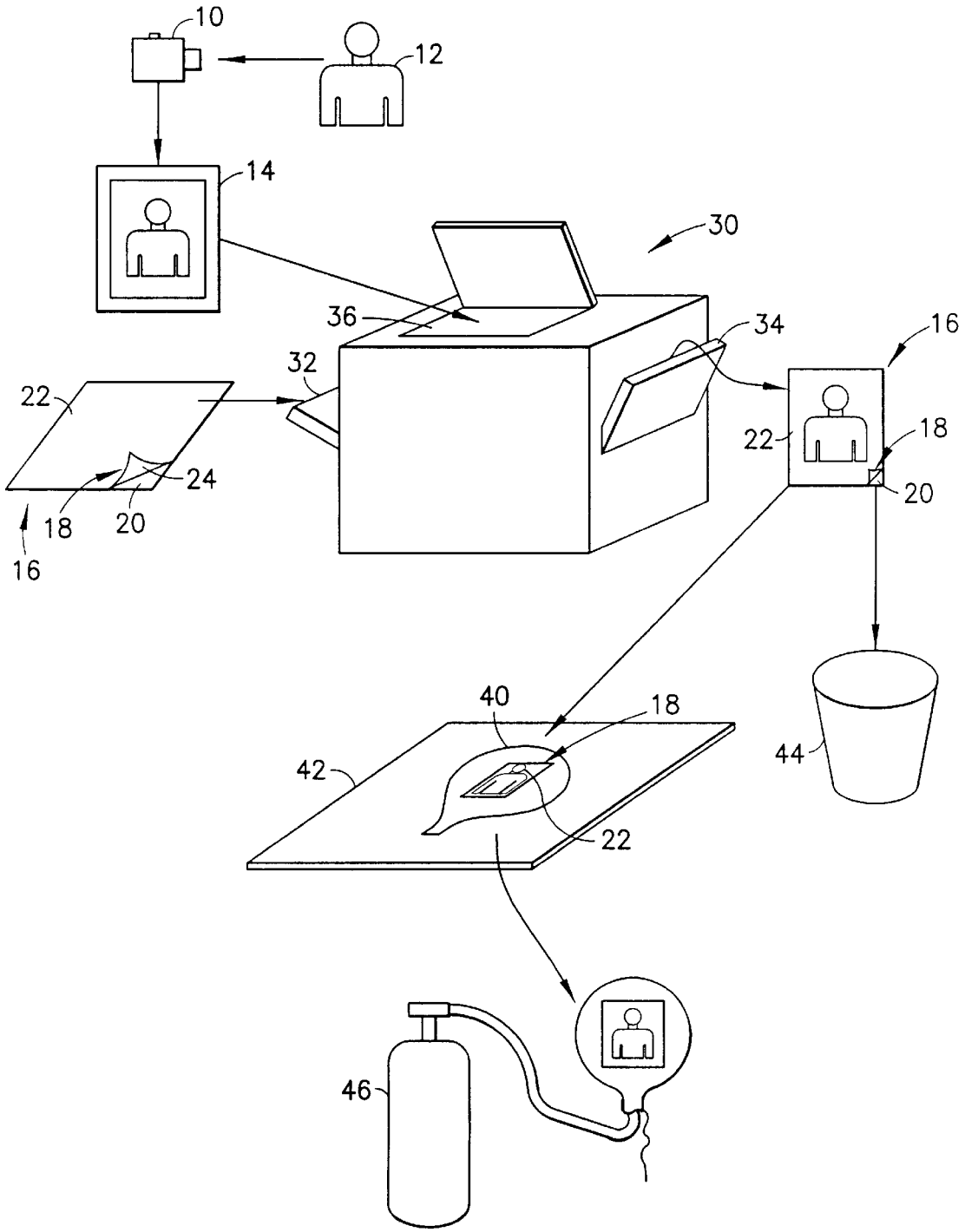
FIG. 1 is a schematic diagram showing the steps of the method of the subject invention.

With reference to FIG. 1, the subject invention is directed to a method for producing a balloon having personalized indicia thereon and to the resulting balloon. As depicted herein, the personalized indicia, as illustrated and described, is a photographic representation of an individual. The photographic representation of a house, a car or a new product similarly could be provided. Alternatively, personalized indicia other than a photograph could be provided, such as a printed logo or personalized message. Still further, photographic and non-photographic indicia could be combined.

As shown in FIG. 1, the method includes a first step of employing a camera 10 to take a photograph of the person 12 to produce a photographic print 14. The photographic print 14 includes a photographic likeness of the person 12.

The method further includes the step of providing a laminated sheet of plastic film identified generally by the numeral 16. The laminated sheet 16 includes a plastic top sheet 18 and a peelably removable backing sheet 20. The top sheet 18 preferably is a transparent or translucent polyester film having a thickness of about 1.0 mil. The top sheet 18 includes a front face 22 suitably finished for receiving and retaining a toner applied thereto. More particularly, the front face 22 is appropriately finished for having images or other indicia applied thereto by a black and white photostatic copier, a color copier or commercially available printers, such as inkjet printers or laser printers. The top sheet 18 further includes a rear face 24 having a pressure sensitive adhesive applied thereto. The pressure sensitive adhesive on the rear face 24 can be employed by merely peelably removing the back sheet 20 from the laminated sheet 16.

The laminated sheet 16 preferably is very thin and is formed to withstand the heat and pressure generated in a copier, such as a color copier without impeding the removal of the backing sheet 20 and without affecting the adhesive applied to the rear face 24 of the top sheet 18. A laminated sheet 16 that has proved successful is marketed by Rayvan under the brand name Repro Film.

The method proceeds by providing a photostatic copier 30, such as a Cannon Color Laser Copier Model 700. The copier 30 has a paper tray 32, an output tray 34 and a glass plate 36 onto which an original to be copied may be placed. The method proceeds by loading the laminated sheet 16 into the paper tray 32 and by placing the photograph 14 face down on the glass plate 36 of the copier. The copier 30 is then operated in the conventional manner such that the image on the photograph 14 is reproduced onto the front face 22 of the top sheet 18 of the laminated sheet 16. The laminated sheet 16 with the image thereon then is fed into the output tray 34.

Figure 2:
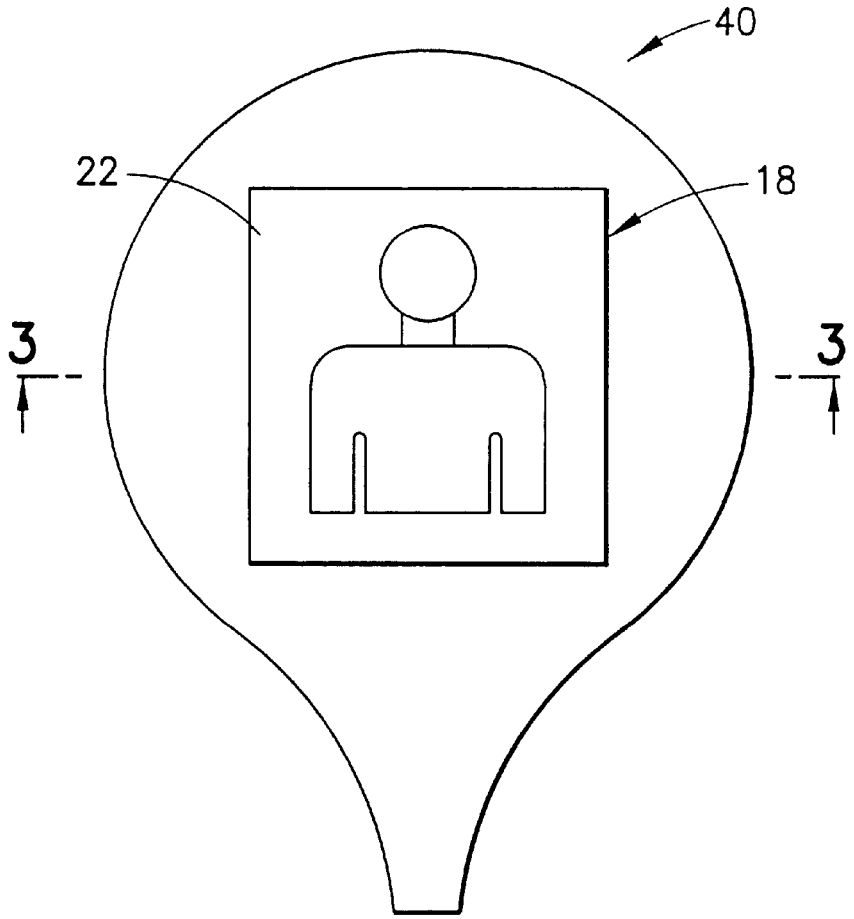
FIG. 2 is a top plan view of a balloon in accordance with the subject invention.
Figure 3:
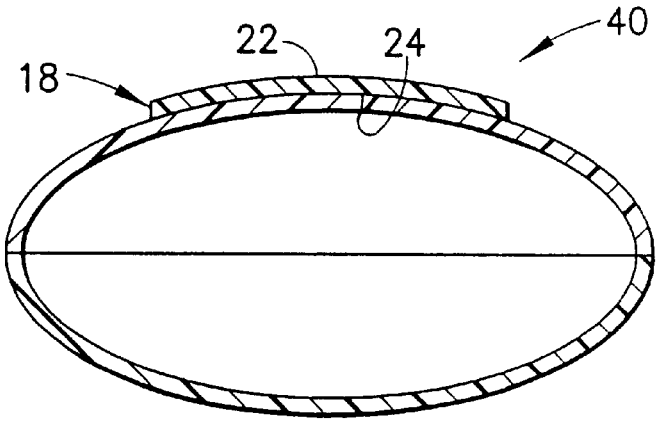
FIG. 3 is a cross-sectional view taken along line 3—3 in FIG. 2.

The method proceeds by providing a deflated balloon 40 that may be a foil balloon or a latex balloon. The deflated balloon 40 is supported on a planar support 42. The method continues by peelably removing the backing sheet 20 from the laminated sheet 16 having the image thereon. The backing sheet 20 is discarded in a receptacle 44. The rear surface 24 of the top sheet 18 then is placed in a desired position on the deflated balloon 40 and pressure is applied to the front face 22 such that the pressure sensitive adhesive on the rear face 24 secures the film 18 having the image thereon to the deflated balloon 40. The deflated balloon 40 is then moved to a canister 46 of helium or other compressed gas, and the helium or other compressed gas is directed into the balloon 40. The helium causes the balloon 40 to inflate and to assume a non-planar configuration, as shown in FIGS. 2 and 3, with the specific shape being dictated by the original shape of the deflated balloon. The film 18 with the image thereon conforms to the non-planar shape of the balloon 40 and will be securely retained on the balloon 40 by the adhesive material pre-applied to the rear face 24.

While the invention has been described with respect to a preferred embodiment, it is apparent that various changes can be made without departing from the scope of the invention. For example, the image applied to the film can be an image other than a photograph. Additionally, the image may be applied to the film by reproduction means other than a color copier. For example, a printer associated with a computer may be employed to transfer the image to the film. These and other variations will be apparent to a person skilled in the art after having read the subject invention disclosure.

I claim:

1. A method for producing a balloon having personalized indicia thereon:

providing a deflated balloon, a reproducible medium with an image to be placed on the balloon and a sheet of expandable plastic film with opposed front and rear faces, the rear face having a layer of adhesive thereon and a peelably removable backing sheet on the adhesive;

copying the image onto the front face of the plastic film;

removing the backing sheet from the plastic;

applying the adhesive backed rear face of the plastic to the deflated balloon; and inflating the balloon.

2. The method of claim 1, wherein the plastic is a polyester film.

3. The method of claim 2, wherein the polyester film is substantially transparent.

4. The method of claim 2, wherein the polyester film has a thickness of about 1.0 mil.

5. The method of claim 1, wherein the step of reproducing the image onto the plastic comprises reproducing the image with a laser copier.

6. The method of claim 1, wherein the image is a photograph, and wherein the method comprises an initial step of photographically producing the image.

7. The method of claim 1, wherein the balloon comprises a foil.

8. A method for applying a photographic image to a balloon, said method comprising the steps of:

providing a selected photograph;

providing a expandable thin flexible laminate comprising a sheet of transparent plastic film having opposed front and rear faces, said rear face having a pressure sensitive adhesive thereon and having a peelably removable backing sheet on said adhesive;

providing a deflated balloon;

loading the laminate into a copier;

copying the photographic image onto the front face of the plastic film;

peelably removing the backing sheet from the rear face of the plastic film;

placing the rear face of the plastic film onto a deflated balloon;

applying pressure to the front face of the plastic film such that the adhesive on the rear face securely adheres the plastic film onto the deflated balloon; and inflating the balloon into a non-planar configuration, such that the plastic film with the image thereon assumes the non-planar configuration of the balloon.

9. The method of claim 8, wherein the balloon is formed from a foil.

10. The method of claim 8, wherein the balloon is formed from latex.

11. The method of claim 8, wherein the photograph is a color photograph, and where the step of loading the laminate into a copier comprises loading the laminate into a color laser copier.

12. The method of claim 8, wherein the copier is a photostatic black and white copier.

* * * * *